US009200631B2

(12) United States Patent
Beal

(10) Patent No.: US 9,200,631 B2
(45) Date of Patent: Dec. 1, 2015

(54) REDUCING FLOW COMMUNICATION BETWEEN CHAMBERS OF GUIDED-VANE ROTARY APPARATUS

(71) Applicant: Arnold J. Beal, Knoxville, TN (US)

(72) Inventor: Arnold J. Beal, Knoxville, TN (US)

( * ) Notice: Subject to any disclaimer, the term of this patent is extended or adjusted under 35 U.S.C. 154(b) by 272 days.

(21) Appl. No.: 13/815,641

(22) Filed: Mar. 13, 2013

(65) Prior Publication Data

US 2014/0271316 A1 Sep. 18, 2014

(51) Int. Cl.
*F04C 2/344* (2006.01)
*F01C 21/08* (2006.01)
*F04C 27/00* (2006.01)

(52) U.S. Cl.
CPC ..... *F04C 2/344* (2013.01); *F01C 21/0836* (2013.01); *F04C 27/005* (2013.01)

(58) Field of Classification Search
CPC ..... F01C 1/3446; F01C 19/005; F01C 19/04; F01C 19/08; F01C 21/0809; F01C 21/0836; F02B 53/02; F04C 2/344; F04C 27/005
USPC ..... 123/243, 235, 241; 418/258, 259, 260, 418/264
See application file for complete search history.

(56) References Cited

U.S. PATENT DOCUMENTS

| | | | | |
|---|---|---|---|---|
| 3,250,260 | A | 5/1966 | Heydrich | |
| 3,348,494 | A | 10/1967 | Fischer | |
| 3,450,108 | A | 6/1969 | Rich | |
| 3,578,889 | A * | 5/1971 | Dagne et al. | 418/147 |
| 3,640,648 | A | 2/1972 | Odawara | |
| 3,727,589 | A * | 4/1973 | Scott | 418/260 |
| 3,863,611 | A | 2/1975 | Bakos | |
| 3,904,327 | A | 9/1975 | Edwards et al. | |
| 3,988,083 | A | 10/1976 | Shimizu et al. | |
| 4,212,603 | A | 7/1980 | Buran et al. | |
| 4,299,097 | A * | 11/1981 | Shank et al. | 62/229 |
| 4,692,104 | A * | 9/1987 | Hansen | 418/61.1 |
| 4,859,163 | A | 8/1989 | Schuller | |
| 4,998,868 | A | 3/1991 | Sakamaki et al. | |
| 5,030,074 | A | 7/1991 | Sakamaki et al. | |
| 5,277,158 | A | 1/1994 | Pangman | |
| 5,429,084 | A * | 7/1995 | Cherry et al. | 123/243 |
| 5,634,783 | A | 6/1997 | Beal | |
| 6,945,218 | B2 * | 9/2005 | Patterson | 123/264 |
| 2009/0223480 | A1 * | 9/2009 | Sleiman et al. | 123/243 |

* cited by examiner

*Primary Examiner* — Thai Ba Trieu
*Assistant Examiner* — Jason T Newton
(74) *Attorney, Agent, or Firm* — Michael E. McKee

(57) ABSTRACT

A guided-vane rotary apparatus having working chambers and rotor hub sectors which are separated from one another by vane assemblies and which rotate within a housing opening embody features which reduce the likelihood of flow communication between the working chambers. To this end, the apparatus includes sealing arrangements which are disposed between the walls of the housing opening and the vane assemblies and between the vane assemblies and the hub sectors between which the vane assemblies are positioned. Furthermore, the housing is provided with seal-accepting recesses adjacent its opening, and a sealing ring is closely accepted by each recess. Wave springs are disposed between the bottom of the recesses and the sealing rings for biasing the sealing rings axially of the apparatus and into sealing engagement with adjacent surfaces of the apparatus.

19 Claims, 8 Drawing Sheets

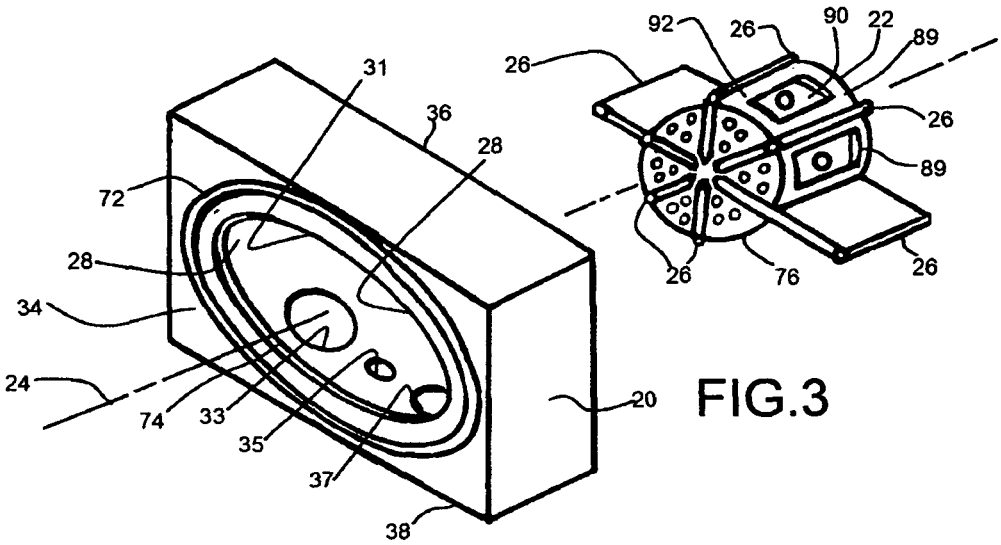
FIG.3
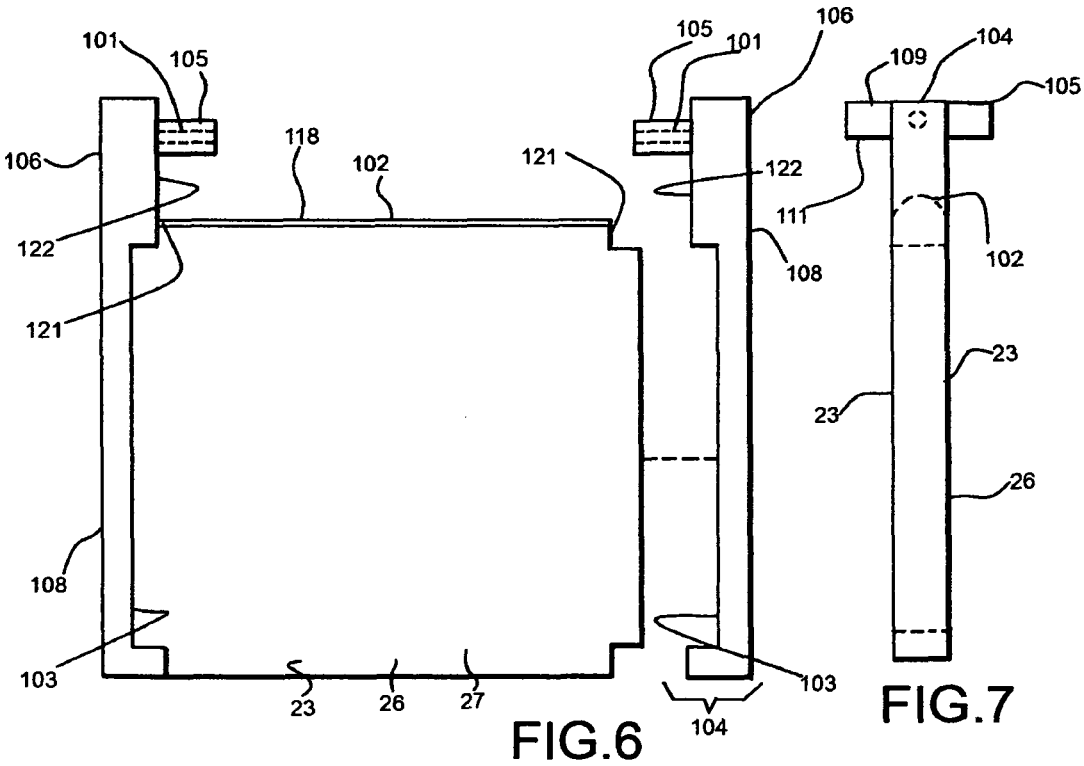
FIG.6
FIG.7

REDUCING FLOW COMMUNICATION BETWEEN CHAMBERS OF GUIDED-VANE ROTARY APPARATUS

BACKGROUND OF THE INVENTION

This invention relates generally to guided-vane rotary apparatus and relates, more particularly, to means and methods for reducing flow communication between the working chambers of such apparatus during operation.

Guided-vane rotary apparatus with which this invention is concerned includes a rotor which rotates within the interior of a housing and vanes which are associated with the rotor and housing for dividing the housing interior into working chambers. Commonly, the vanes are mounted within the rotor and are adapted to slide relative thereto between alternative radial positions as the rotor is rotated within the housing. This class of apparatus can find application as a positive displacement machine, such as an internal combustion engine, a pump, a compressor, or a fluid-operated motor. An example of such a guided-vane rotary apparatus is shown and described in U.S. Pat. No. 5,634,783, naming the same inventor as the instant application.

In order to enhance the efficiency of a guided-vane rotary apparatus of the aforedescribed class, it would be desirable that the working chambers of the apparatus be effectively sealed from one another to prevent a leakage or flow of the working gases or fluid contained in one chamber of the apparatus to another chamber of the apparatus. In other words, when such leakage is permitted, any pumping efficiency or effectiveness of the apparatus as a positive displacement machine is impaired. However, current designs have not proven to be entirely satisfactory in this respect.

It would be desirable to provide a guided-vane rotary apparatus whose structure reduces or limits any flow communication between the working chambers of the apparatus.

Accordingly, it is an object of the present invention to provide a guided-vane rotary apparatus whose structure reduces the likelihood of flow communication between working chambers of the apparatus during the operation of the apparatus.

Another object of the present invention to provide such an apparatus having an improved scheme for sealing the working chambers of the apparatus from one another.

Still another object of the present invention is to provide such an apparatus which is uncomplicated in structure, yet effective in operation.

SUMMARY OF THE INVENTION

This invention resides in a guided-vane rotary apparatus including a housing including a body having two opposite, substantially planar side faces, an opening extending between the side faces and a seal-accepting recess encircling the opening on at least one of the side faces. The recess defines a bottom surface which is substantially parallel to the at least one side face and an outermost surface which extends between the bottom surface and the at least one side face. In addition, a rotor assembly includes a body mounted within the opening of the housing body for rotation about an axis and defines a slot extending radially of the rotation axis. The rotor assembly further includes a disk which is mounted adjacent the at least one side face of the housing body so as to cover the opening of the housing body, and the disk includes an inner side face which faces the at least one side face of the housing body. The at least one side face of the housing body defines a cam groove which encircles the opening in the at least one side face and is disposed outboard of the recess defined therein. Furthermore, a vane assembly is positioned within the slot of the rotor assembly body for movement radially thereof between alternative radial positions, and the apparatus further includes means cooperating between the vane assembly and the cam groove for coordinating the radial movement of the vane assembly relative to the rotor assembly body with the rotation of the rotor assembly body about the axis so that as the rotor assembly body is rotated about its axis through a complete revolution, the vane assembly is forcibly moved radially inwardly and outwardly with respect to the rotor assembly body by a corresponding amount. Further still, a sealing ring is accepted by the seal-accepting recess and has a front face which faces the inner side face of the disk and a rear face opposite the front face. Moreover, biasing means are disposed between the bottom surface of the seal-accepting recess and the rear face of the sealing ring axially with respect to the housing body opening for urging the front face of the sealing ring against the inner side face of the disk.

In one particular embodiment of the invention, the opening of the housing body has outer walls along which the vane assembly is slidably moved during apparatus operation, and the vane assembly includes a vane body having a radially outwardly-directed edge and two opposite ends. Furthermore, there is defined along the radially outwardly-directed edge a groove having a bottom which extends therealong, and the vane assembly further includes a vane tip seal which is disposed within the groove and extends therealong so as to provide a radially outwardmost edge of the vane assembly. In addition, means are disposed between the bottom of the groove and the vane tip seal for biasing the radially outwardmost edge of the tip seal radially outwardly of the rotor assembly and into engagement with the walls of the opening of the housing body. Moreover, the vane tip seal has a length which is at least as long as the full width of the opening of the housing body wherein the full width is measured between the two opposite, substantially planar side faces of the housing body.

In another particular embodiment of the invention, the body of the rotor assembly includes two hub sectors having opposing radially-extending surfaces between which is defined the slot within which the vane assembly is positioned. Furthermore, the vane assembly includes a body having a side face which faces the radially-extending surface of one of the hub sectors and another side face which faces the radially-extending surface of the other of the hub sectors, and each opposing radially-extending surface of the two hub sectors defines a seal-accepting groove which extends substantially axially of the rotor assembly. Also included in this embodiment are two strip seals wherein each strip seal is disposed within a seal-accepting groove of a radially-extending surface of a corresponding hub sector and means disposed between the bottom of the seal-accepting groove of a corresponding hub sector and the strip seal accepted by the corresponding seal-accepting groove for biasing the strip seals into sealing engagement with a side face of a corresponding vane assembly body.

BRIEF DESCRIPTION OF THE DRAWINGS

FIG. 3 is a perspective view of the housing block, rotor sectors and vanes of the FIG. 1 engine, shown exploded.

FIG. 6 is a front elevation view of an exemplary vane and pair of linkage assemblies of the FIG. 1 engine, shown exploded.

FIG. 7 is a side elevation view of the FIG. 6 vane and linkage assembly, as viewed from the right in FIG. 6.

DETAILED DESCRIPTION OF THE ILLUSTRATIVE EMBODIMENT

Figure 1:
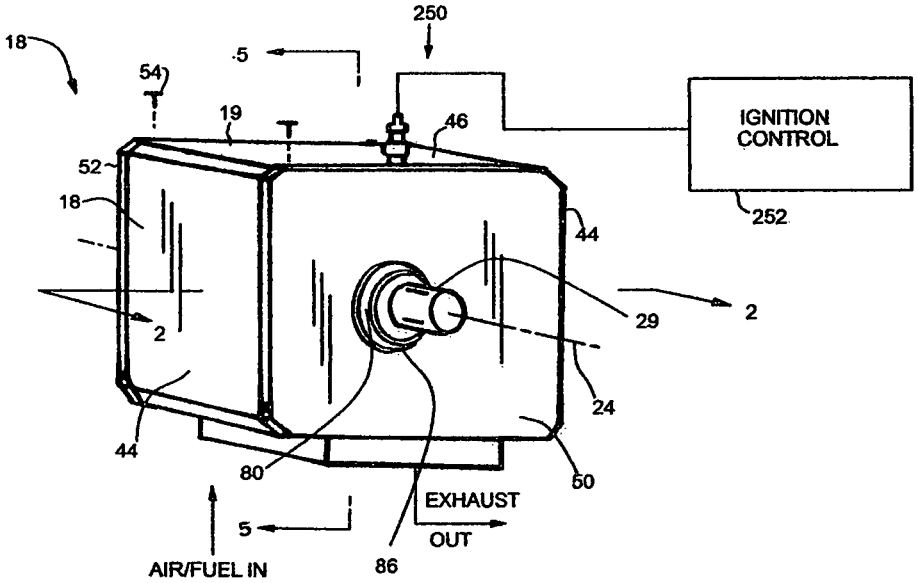
FIG. 1 is a perspective view of an internal combustion engine within which features of the present invention are embodied.
Figure 2:
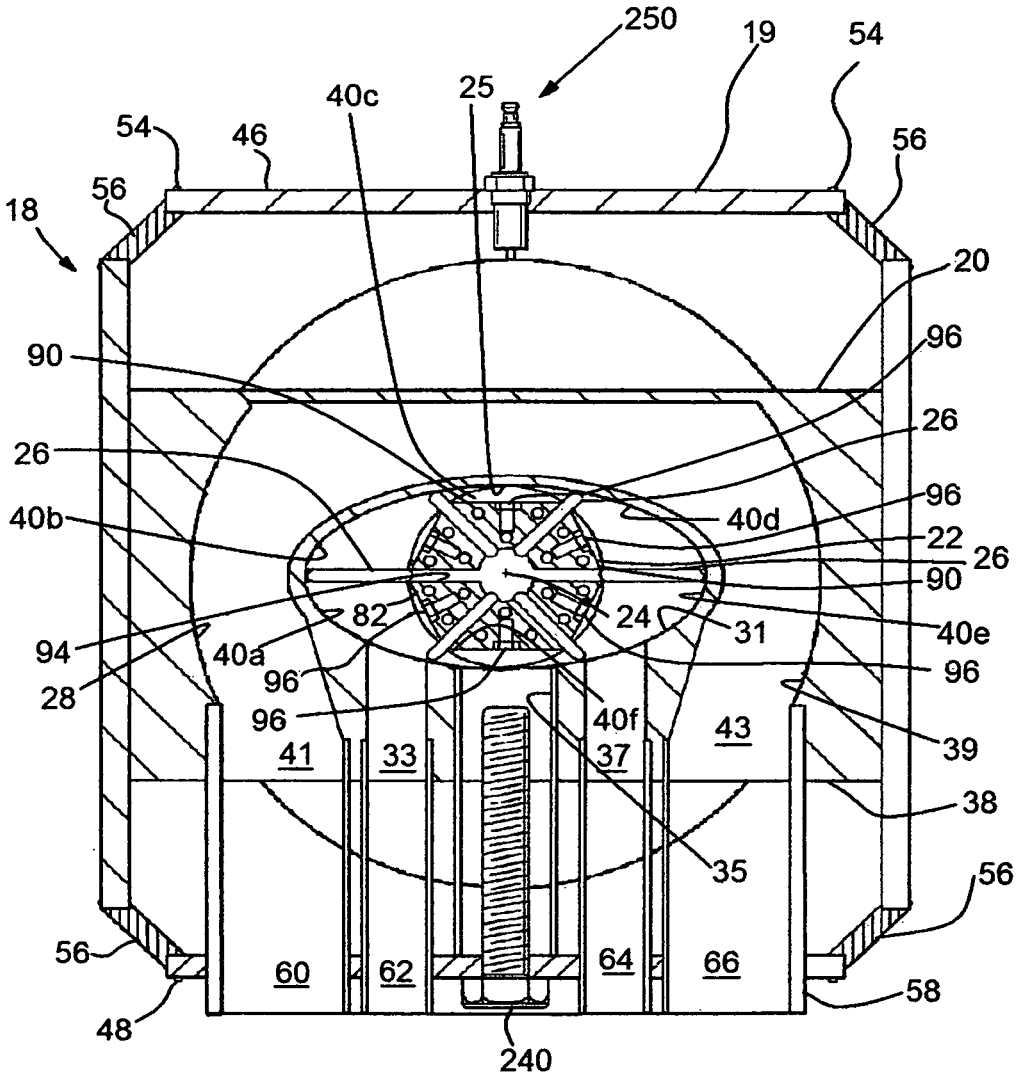
FIG. 2 is a cross-sectional view taken about along line 2-2 of FIG. 1.

Turning now to the drawings in greater detail, there is shown in FIGS. 1 and 2 an internal combustion engine, generally indicated 18, within which features of the present invention are embodied. The engine 18 is a guided vane-type rotary apparatus including means providing an outer housing 19, a housing block 20 mounted within the outer housing 19, means providing a rotor, or rotor assembly, 22 mounted within the housing block 20 for rotation about an axis 24, a plurality of vanes, or vane assemblies, 26 which, with the rotor 22 and housing block 20, divide the interior, indicated 28, of the housing block 20 into a plurality of (i.e. six) working chambers **40*a*-40*f*. In the depicted engine 18, the vane assemblies 26 are slidably mounted within the rotor 22 for sliding movement thereto between alternative radial positions. The engine 18 also includes means, generally indicated 30 in FIG. 4, connected to the vane assembly 26 and acting upon the housing block 20, for coordinating the radial movement of the vane assemblies 26 as the rotor 22 is rotated about the axis 24. More specifically, the coordinating means 30 cooperates with the housing block 20 to shift the vane assemblies 26 toward and away from the axis 24 in conjunction with the rotation of the rotor 22 within the housing 20**.

Although the embodiment 18 described herein is an internal combustion engine adapted to convert forces generated by the combustion of an air/fuel mixture to rotary motion by way of an output shaft 29 (FIG. 1), several features of the invention described herein are adaptable to other guided-vane rotary apparatus, such as pumps, compressors, and fluid-operated motors. Accordingly, the principles of the invention can be variously applied.

As will be apparent herein, the engine 18 includes an improved scheme for sealing the working chambers of the engine 18 from one another to reduce the likelihood that flow communication will be permitted between working chambers of the engine 18. Furthermore and inasmuch as the engine 18 includes a plurality of spark plugs, described herein, for igniting an air/fuel mixture directed into the housing interior 28, these spark plugs are mounted within the rotor 22 of the engine 18, rather than within the housing block 20 thereof.

As best shown in FIGS. 2 and 3, the housing block 20 of the depicted engine 18 has an outer shape which resembles a rectangular prism and has an inner opening 31 of substantially elliptical cross-section which extends between opposite side faces, indicated 34 and 36, of the block 20. In addition, there are provided passageways 33, 35 and 37 which extend between the bottom surface, indicated 38 in FIG. 2, and the opening 31 which provide, respectively, an air/fuel inlet passageway, a spark plug access opening, and an exhaust passageway. In addition, a hollow inner cavity 39 is provided in the housing block 20 so as to substantially encircle the opening 31 and coolant passageways 41, 43 which extend between the bottom surface 38 and the cavity 39 to permit coolant to be circulated through the cavity 39.

With reference again to FIGS. 1 and 2, the outer housing 19 includes a plurality of end plates 44, a top plate 46, a bottom plate 48 and sidewall plates 50, 52 which are fixedly connected to the end surfaces of the housing block 20 and to one another by way of screws 54 (FIG. 1) and corner members 56 (best shown in FIG. 2) so that when assembled, the outer housing 19 substantially encloses the housing block 20. In addition, a manifold assembly 58 is securely joined to the bottom plate 48 of the outer housing 19 and embodies ports 60, 62, 64 and 66 which are joined in flow communication, respectively, with the coolant passageway 41, the air/fuel inlet passageway 33, the exhaust passageway 37 and the coolant passageway 43 of the housing block 20.

Figure 4:
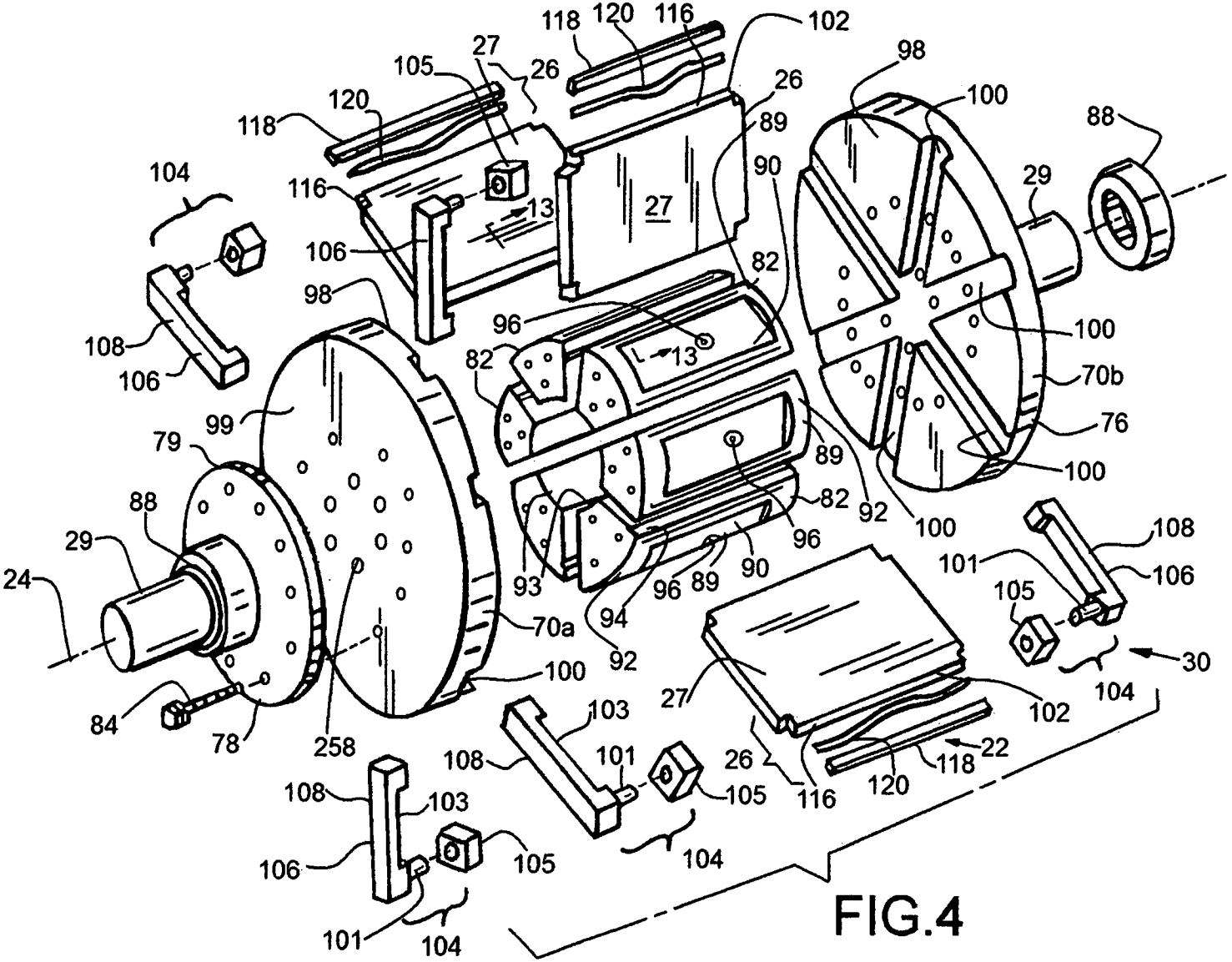
FIG. 4 is a perspective view of various components of the FIG. 1 engine, shown exploded.

With reference to FIGS. 3 and 4, the interior 28 of the housing 20 accepts the rotor 22 directed endwise therein and is enclosed at the side faces 34, 36 thereof by way of a pair of rotor discs **70*a*, 70*b* positioned adjacent the side faces 34, 36. Meanwhile, the rotor 22, along with the vane assemblies 26, are sandwiched between the rotor discs 70*a*, 70*b*. It follows that the walls of the opening 31 provide the sidewalls of the housing interior 28 within which the rotor 22 is positioned. Furthermore, each side face 34 or 36 of the housing block 20 defines a shallow groove 72 of substantially rectangular cross section and a sealing-accepting recess 74 which encircles the mouth of the opening 31. Each of the groove 72 and recess 74 is endless in that each is continuous about the opening 31 and follows a substantially elliptical, i.e. non-circular, path thereabout, and the purposes of the groove 72 and recess 74** will be apparent herein.

During operation of the depicted engine 18 and with reference again to FIG. 2, the rotor 22 is intended to rotate within the housing block 20 in a clockwise direction about the axis 24. This being the case and as the cycles of the internal combustion process of the engine 18 are carried out within the housing interior 28, an air/fuel mixture is permitted to enter the interior 28 by way of the manifold port 62, and the products of combustion are permitted to exit the interior 28 by way of the manifold port 64. Meanwhile, the engine 18 is cooled with coolant routed through the cavity 39 by way of the manifold ports 60 and 66.

Figure 5:
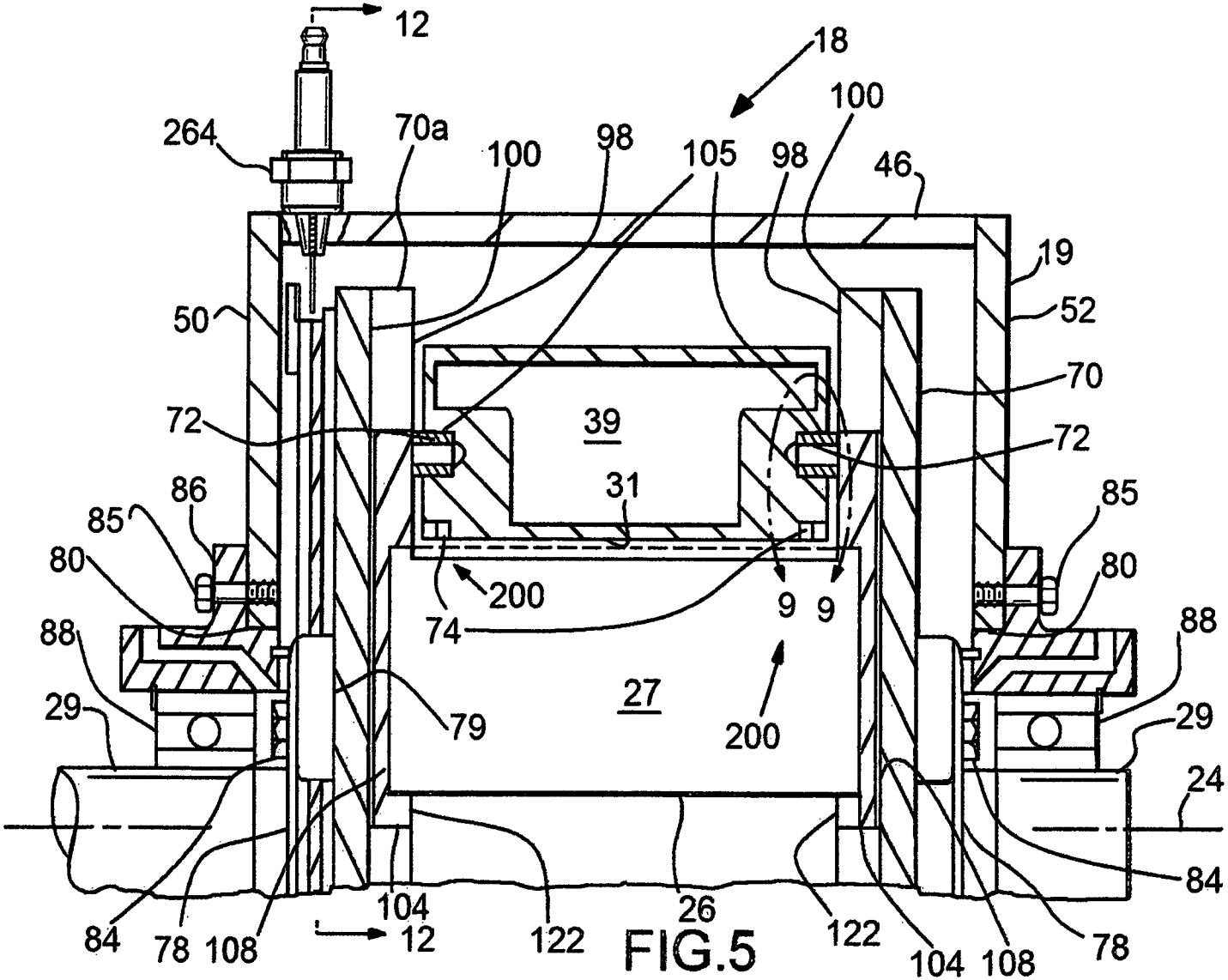
FIG. 5 is a view which illustrates schematically a longitudinal cross section of the FIG. 1 engine wherein the cross section is taken about along line 5-5 of FIG. 1.
Figure 8:
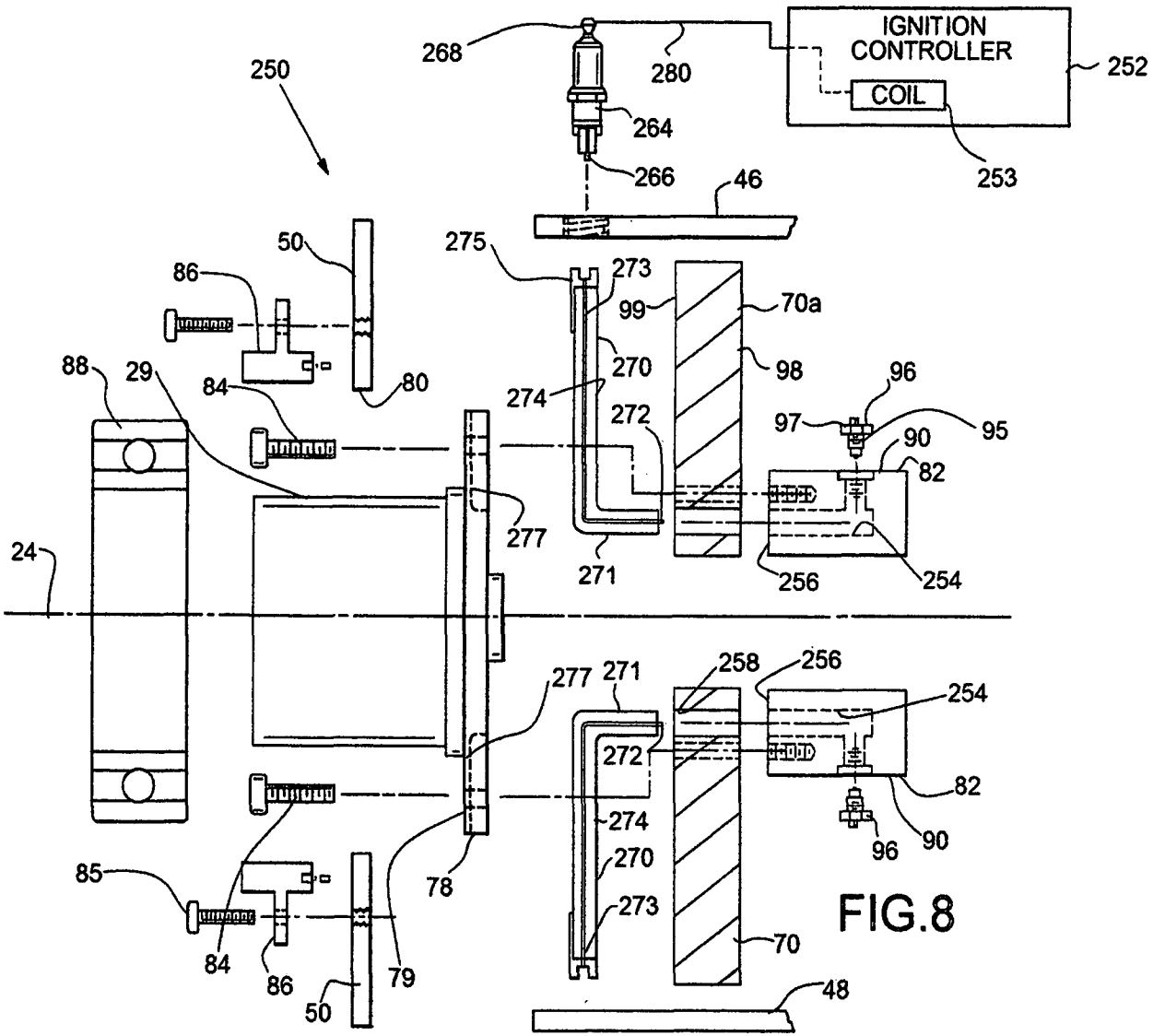
FIG. 8 is a fragmentary cross-sectional view, similar to that of FIG. 5, of some of the engine components depicted in FIG. 5, but shown exploded.

With reference to FIGS. 4, 5 and 8, the rotor 22 includes a somewhat spool-shaped assembly 76 including a pair of shaft-bearing flanges 78 having a shaft 29, a flange portion 79, the pair of circular rotor disks **70*a*, 70*b* (introduced earlier), and a plurality of, i.e. six, central hub sectors 82 which are regularly spaced about the axis 24. Each shaft flange 78 and disk 70*a* or 70*b* is fixedly joined, as with bolts 84, to a corresponding end of the sectors 82 so that these joined elements must rotate together as a single unit with no relative movement therebetween. When mounted within the housing 20, the center of mass of this unitary rotor assembly 76 is located along the rotating axis 24, and the shafts 29 extend through a central opening 80 (FIG. 1) of the housing sidewall plates 50, 52. When extending through the sidewall plate openings 80 in this manner, the shafts 29 support the rotor 22 for rotation about the axis 24, as well as transmit rotational forces from the rotor 22. An anti-friction bearing, such as a ball bearing 88, is retainably positioned between the surfaces of the shaft 29 and the sidewall plate opening 80 disposed on each side of the engine 18 by way of a flange 86 which is tightly positioned about the bearing 88 and mounted upon a corresponding sidewall 50 or 52 (with bolts 85) to facilitate the rotation of the rotor 22 relative to the housing block 20**.

With reference still to FIG. 4, each hub sector 82 is shaped to somewhat resemble a truncated sector of a right circular cylinder having an outwardly-directed surface 89 (comprised of rounded, or arcuate-shaped, edge portions 92 and substantially flat portions 90 disposed centrally of the edge portions 92), and an inwardly-directed surface 93. In addition, each sector 82 is attached at its ends to the rotor disks 70*a*, 70*b* (e.g. with bolts 84) so that each sector 82 is maintained in a spaced relationship with its adjacent sector 82. The spacing, indicated 94 in FIGS. 2 and 4, provided between adjacent sectors 82 provides a slot within which a corresponding vane assembly 26 is slidably positioned. The arcuate-shaped portion 92 of the outwardly-directed surface 89 of each sector 82 is shaped to provide a relatively close operating proximity with the walls of the housing interior 28 as the sector 82 passes through the housing interior 28.

Furthermore and as will be described in greater detail herein, it is within the substantially flat portion 90 of the outwardly-directed surface 89 of each hub sector 82 that a spark plug 96 is mounted in order to ignite the air/fuel mixture when the hub sector 82 passes through the combustion phase, or period, of the engine cycle. However and in an embodiment of an apparatus of the invention which is not an engine (and is instead, for example, a pump, compressor or a fluid-operated motor), the presence of flat portions (like that of the flat portions 90) within the rotor hub sectors is less desirable.

With reference still to FIG. 4, each rotor disk 70*a* or 70*b* includes an interior face 98 which is provided with a series of grooves 100 which extend radially across the disk face 98. In the depicted embodiment 18, there are six radially-extending grooves 100, and the opening of each groove 100 is aligned with (i.e. in registry with) a corresponding space 94 provided between adjacent sectors 82. During rotation of the rotor 22 within the housing interior 28, these grooves 100 provide guide tracks along which the vane assemblies 26 are guided as each vane assembly 26 is shifted radially of the rotor 22.

With reference to FIGS. 4-7, each vane assembly 26 (only three shown in FIG. 4) includes a vane body 27 which is generally platen-like in shape, is sized to be slidably accepted by a corresponding spacing 94 provided between each pair of adjacent sectors 82, and includes an outwardmost tip edge 102. Also included in each vane assembly 26 is a vane tip seal 118 and a bias spring 120 which are positioned within an elongated groove 116 which extends along the length of the tip edge 102 of the vane body 27. As will be apparent herein, during rotation of the rotor 22 within the housing interior 28, it is the outermost edge of the tip seal 118 which provides the outer edge of the vane assembly 26 and slidably moves in engagement with the walls of the housing opening 31 to maintain an effective seal therebetween.

With reference again to FIG. 2, the vane assemblies 26, in conjunction with the surfaces 89 of the rotor sectors 82, divide the housing interior 28 into six working chambers 40*a*-40*f*. Due to the non-circular walls of the interior 28, the chambers vary in volume through a single revolution of the rotor 22 about the axis 24. It will be appreciated that as the rotor 22 is rotated relative to the housing 20 about the axis 24 in a clockwise direction, as viewed in FIG. 2, an air/fuel mixture which enters the housing interior 28 through the intake port 62 (and subsequently becomes trapped within a chamber), is subsequently compressed as the vane assemblies 26 (whose tip seal 118 slidably moves along the walls of the housing 28) are rotated by the rotor 22 toward an uppermost (i.e. top dead center) location, indicated 25 in FIG. 2, where combustion occurs. Within the depicted engine 18, the top dead center location 25 corresponds with the location at which each working chamber attains its minimum volume at the end of its compression cycle. As the chambers continue to be rotated along the right side, as viewed in FIG. 2, of the interior 28, the shape of the chambers accommodate the expansion and subsequent exhaust cycles of the engine operation.

For purposes of shifting the vane assemblies 26 radially of the rotor 22 during engine operation so that the vane tip seals 118 of the vane assemblies 26 are maintained in sealing engagement with the walls of the housing interior 28, the coordinating means 30 of the engine 18 includes a plurality of linkage assemblies 104 interposed between the vane assemblies 26 and the grooves 72 (FIG. 4) provided in the side faces 34, 36 of the housing body 20. As best shown in FIGS. 6 and 7, each linkage assembly 104 (only five shown in FIG. 4) includes an elongated linkage element 106 having a bar portion 108 and a transversely-extending pin portion 101 which extends to one side of the bar portion 108. The side of the bar portion 108 corresponding with the pin portion 101 defines a notch 103 within which one side of a vane body 27 of a vane assembly 26 is tightly captured. Accordingly, the notch 103 is sized to closely, or tightly, accept a correspondingly-shaped side edge of a vane body 27 when the vane body 27 is directed edge-ways therein. Furthermore, each bar portion 108 is slidably received within a corresponding groove 100 defined along an interior face 98 of the disk 70*a* or 70*b* to accommodate sliding movement longitudinally therealong, and each bar portion 108 is sized to closely fit within its corresponding groove 100. It is a feature of the depicted engine 18 that the thicknesses of the bar portions 108 and the side edges of the vane body 27—which thickness is measured between the side faces 23 (FIGS. 6 and 7) of the vane body 27 thereof—accepted thereby are substantially equal to ensure tight, or seal-forming, acceptance of the side edge of the vane body 27 by the notch 103 and to enhance the seal between working chambers of the engine 18 during operation.

Each linkage assembly 104 also includes a camming, i.e. a cam follower, element 105 positioned about the pin portion 101 and which is received by the groove 72 (FIGS. 3 and 5) provided in a side face 34 or 36 of the housing block 20. To this end, the depicted cam follower element 105 is somewhat block-shaped (and non-circular) in form so as to provide opposite outwardmost and inwardmost surfaces 109 and 111 (FIG. 7), respectively, and includes a central opening through which the pin portion 101 extends. When the linkage assemblies 104 are assembled about a vane assembly 26 (as shown in FIG. 5) and positioned within the housing 20, the two bar portions 108 of the linkage assemblies 104 are positioned on opposite sides of each vane assembly 26 and each of two cam follower elements 105 is positioned within a groove 72 provided in the side face 34 or 36. When each bar portion 108 is positioned within a corresponding groove 100 defined along the disk face 98, the vane assembly 26 captured therein is provided with full end support and prevented from shifting relative to the bar portion 108 along the length thereof.

Accordingly, as the rotor 22 is rotated about the axis 24 and the bar portions 108 are shifted longitudinally of the disk grooves 100 in the manner described herein, each vane assembly 26 is forced to shift radially of the rotor 22 with the bar portions 108. It will also be understood that the vane body 27 is supported, to some degree, by the radially-extending surfaces of the hub sectors 82 and thereby prevented from shifting tangentially of the rotor 22.

As described earlier, the groove 72 provided in each side face 34 or 36 of the housing block 20 extends continuously about the body opening 31 in an unbroken loop. During rotation of the rotor 22 about the axis 24, each groove 72 provides a continuous closed track, i.e. a cam groove, in the corresponding side face 34 or 36 along which the cam follower elements 105 slidably move. If desired and to compensate for the curvature in the inner and outer walls of the groove 72, the surfaces of each cam follower element 105 which face the inner or outer wall of the groove 72 can be provided with a curvature which substantially matches that of the inner or outer wall of the groove 72.

It follows that as the rotor 22 is rotated about the axis 24, the vane assemblies 26, which are captured within the rotor spaces 94, must rotate about the axis 24 as well. Because the slidable cam follower elements 105 of the linkage assemblies 104 are captured within the elliptical cam grooves 72 for sliding movement therealong and must consequently shift toward and away from the axis 24 during a single revolution of the rotor 22 about the axis 24 in accordance with the shape of the elliptical path of the groove 72, the vanes 26 must shift toward and away from the rotation axis 24 during a single revolution of the rotor 22 about the axis 24. It also follows the vane tip seals 118 of the vane assemblies 26 are maintained in engagement with the walls of the housing interior 28 as the linkage assemblies 104 maintain a fixed spacing between the outermost edges of the tip seals 118 and the grooves 72. Moreover, the vane body 27 of each vane assembly 26 is sized so that when shifted to its radially outwardmost position during a revolution of the rotor 22, a portion of each vane body 27 remains captured within the rotor spacing 94.

The aforedescribed equality of the thicknesses between the bar portions 108 of the linkage assemblies 104 and the edges of the vane bodies 27 of the vane assemblies 26 accepted by the notches 103 of the linkage assemblies 104 and the disc grooves 100 provides advantages relating to the strength of the vane assemblies 26 and the sealing of the working chambers of the engine block 18 from one another. For example and insofar as the vane assemblies 26 are bodily moved radially of the rotor 22 during engine operation, the thicknesses of the vane body 27 (which has been increased over that of vane bodies of the prior art to match that of the bar portions 108), provides the vane body 27 with additional strength to reduce the amount of stress (or stress-induced deformation) to which the vane bodies 27 are likely to be exposed during the radially-directed movement of the vane assemblies 26 during engine operation. Moreover, the linkage faces 122 sealingly engage the front face 216 of the rotor seal assembly 200 as the linkage faces 122 slidably move therealong during engine operation, thus reducing any likelihood of leakage from a chamber of the housing block 20 adjacent, or along, the sealing assembly 200. In other words, the linkage face 122 provides a sealing face for sliding engagement with the rotor seal face 216 to form a continuous, unbroken seal barrier therebetween.

As mentioned earlier and with reference again to FIG. 4, it is preferred that the outermost edge 102 of each vane body 27 is provided with a groove 116 formed therein which extends along the length thereof for receiving the vane tip seal 118. The tip seal 118 is, in turn, backed by the bias spring 120. When assembled within the engine 18, the bias spring 120 urges the vane tip seal 118 radially outwardly with respect to its corresponding vane body 27 so that the tip seal 118 is held, along its full length, in sliding and continuous sealing contact with the wall of the housing block opening 31.

It is also a feature of the present invention that the opposite ends, indicated 121 in FIG. 6, of each vane tip seal 118 sealingly abuts the surface, indicated 122 in FIG. 6, of the corresponding linkage element 106 to provide a seal between these engaging components. To this end, the vane tip seal 118 has a length which is at least as great as the full width of the opening 31 of the housing 20 wherein the full width of the opening 31 is measured between the housing side faces 34 and 36. Further still, the grooves 72 provided in the side faces 34, 36 of the housing block 20 are formed with such a contour so as to maintain the radial position of the tip seal 118 relative to the vane edge groove 116 relatively constant, and thereby maintain a continuous seal between the vane edge 102 and the wall of the housing block opening 31 at any rotational position of rotor 22 about the axis 24. Preferably, the vane tip seal 118 is formed so as to include a radius at its outwardmost edge.

As mentioned earlier and with reference to FIGS. 5 and 9-11, there is provided a seal-accepting recess 74 in the housing block 20 which extends along each edge of the opening 31 provided therein. It is a feature of the invention that this recess 74 accepts a seal assembly 200 intended to reduce the likelihood of flow communication between adjacent working chambers of the housing interior 28 and between the working chambers and the exterior of the housing body 20 or disk face 98. In this connection, the seal assembly 200 (best shown in FIGS. 9 and 10) includes an elliptically-shaped sealing ring 202 which is positioned within the recess 74 and biasing means, generally indicated 204, for urging the sealing ring 202 outwardly of the recess 74 and against the interior face 98 of the adjacent rotor disk 70*a* or 70*b* wherein the disk face 98 is co-planar with the inner surface, indicated 122, of the bar portion 108 of the linkage assembly 104.

Figure 11:
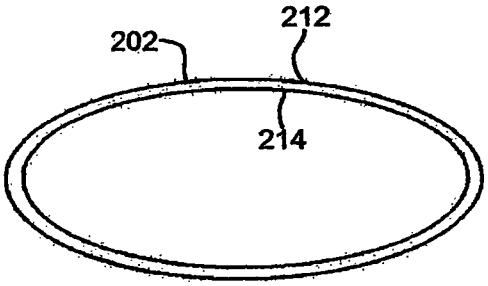
FIG. 11 is an elevation view of the sealing ring depicted in FIGS. 9 and 10, as seen generally from the right in FIGS. 9 and 10.

More specifically, each recess 74 includes a substantially planar bottom surface 206 which is oriented substantially normal to the rotation axis 24 and an outer surface 208 whose curvature (i.e. elliptical in form) substantially corresponds with that of the opening 31 whose mouth is encircled by the recess 74. Furthermore, the sealing ring 202 (whose elliptical shape is best shown in FIG. 11) is substantially rectangular in cross section and is sized to be closely accepted by the spacing provided between the outwardmost surface 208 of the recess 74 and the outer edge of the vane assembly 26 or, more specifically, the outermost edge of the tip seal 118. Within the views of FIGS. 9 and 10, the sealing ring 202 defines a outer surface 212 which faces radially outwardly of the housing interior 28, an inner surface 214 which faces radially inwardly of the housing interior 28, a front face 216 which faces away from the corresponding side face 34 and 36 of the housing block 20, and a rear face 218 which faces the bottom surface 206 of the recess 74.

Within the depicted engine 18, the biasing means 204 is in the form of a wave spring 220 which is disposed between the bottom surface 206 of the recess 74 and the rear face 218 of the sealing ring 202. Like the sealing ring 202, the wave spring 220 is elliptical in form and has a substantially rectangular cross section, although the spring 220 has a plurality of waves formed into its wider, or axially-facing, faces. During use, the wave spring 220 (which is resilient in nature) is capable of being compressed between its front and rear faces from an undeformed condition to a collapsed condition at which the thickness of the spring 220 is slightly smaller than it is when the spring 220 is in its undeformed condition. When the sealing ring 202 is positioned within the recess 74 and the wave spring 220 is sandwiched (i.e. in a compressed condition) between the bottom surface 206 of the recess 74 and the sealing ring 202, the spring 220 acts between the bottom surface 206 and the rear face 218 of the sealing ring 202 to urge the front face 216 axially of the housing opening 31 and into sealing engagement with the inner face 98 of the adjacent disk 70*a* or 70*b* and the surface 122 of the linkage assembly 104.

Because the front face 216 of the sealing ring 202 is urged against the disk surface 98 in the aforementioned manner and because the outwardmost surface 212 of the sealing ring 202 sealingly engages the outer surface 208 of the recess 74 by virtue of the close fit-up relationship therebetween, the likelihood is very small that any gases or fluids which are contained within the working chambers of the engine 18 will pass between the chambers by way of any spacing between the front face 216 and disk surface 98 or between the surfaces 212 and 208 during engine operation. Further still and because the waves of the wave spring 220 are preferably spaced relatively close together, the resulting relatively small spaces formed between the crests of each successive wave of the spring 220 create, with the adjacent surface 206 and rear face 218 of the sealing ring 202, respectively, very small pockets along the length of the spring 202 which are isolated from one another and further reduce the likelihood that gases or fluids could pass (e.g. tangentially of the recess 74) between the working chambers of the engine 18 by way of the recess 74.

Preferably, the wave spring 220 is sized so that when positioned into place within the recess 74 arranged in a compressed condition between the bottom surface 206 of the recess 74 and the rear surface 218 of the sealing ring 202, the wave spring 220 substantially fills the entirety of the space which exists between the bottom surfaces 206 and the rear face 218 of the sealing ring 202 to help prevent any passage of gas or fluid between the working chambers of the engine 18 by way of the recess 74.

Furthermore, the width of the sealing ring 202 (as measured radially across its front face 216 (and thus between the inner and outer surfaces thereof) is substantially equal to the distance between the outer edge of the vane tip seal 118 and the outer surface 208 of the recess 74 to seal the engaging surfaces of the outer surface 212 of the sealing ring 202 and the outer surface 208 of the recess 74 and to provide (with the outer wall of the housing opening 31) a smooth, substantially continuous surface as a path is traced axially across the outer wall of the housing opening 31 and across the inner surface, indicated 220, of the wave spring 220 and the inner surface 214 of the sealing ring 202 to provide a smooth, substantially unbroken surface across which the vane tip seal 118 slidably moves during engine operation. In other words, this smooth, substantially unbroken surface across the wall of the housing opening 31 which spans the entire distance between the surfaces 122 of the linkage elements 106 disposed on opposite sides of the housing opening 31 enhances the seal with the outer edge of the vane tip seal 118 as the vane tip seal 118 slides therealong during operation of the engine 18.

Figure 9:
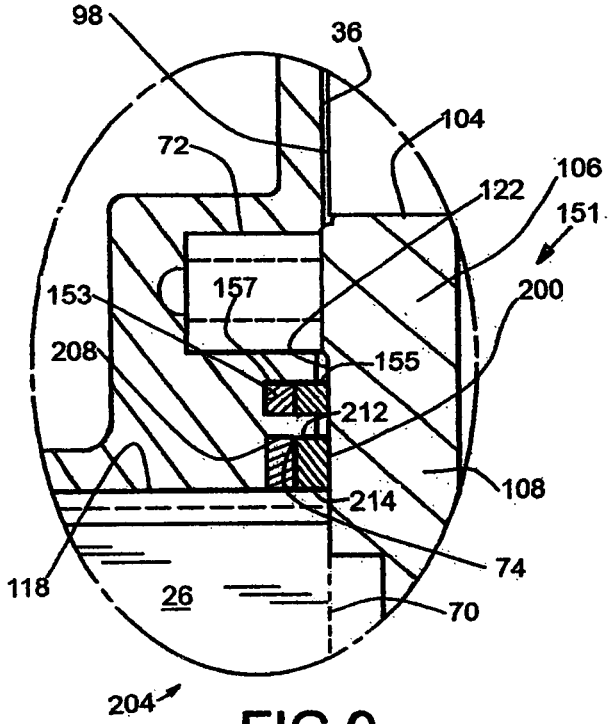
FIG. 9 is a portion of the FIG. 5 view taken about along line 9-9 of FIG. 5, but drawn to a slightly larger scale.
Figure 10:
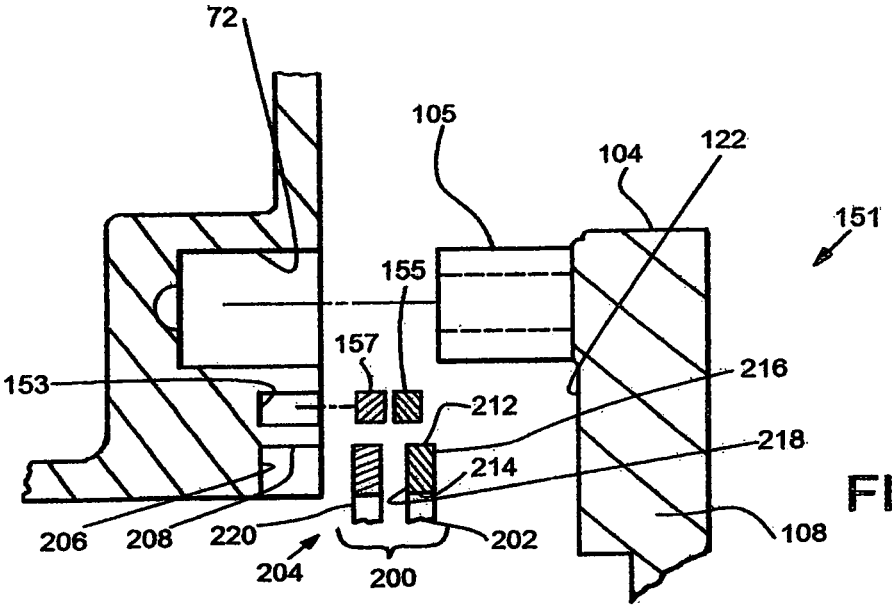
FIG. 10 is a view, similar to that of FIG. 9, of the components of FIG. 9, but shown exploded.

With reference still to FIGS. 9 and 10 and if desired, the engine 18 can be provided with a back-up sealing means, generally indicated 151, for sealing the running clearance between the rotor disk faces 98 and linkage inner surface 122 and the side faces 34 and 36 of the housing body 20. To this end, each housing side face 34 or 36 is provided with a continuous rotor seal groove 153 located outboard of the recess 74, and there is positioned within the groove 153 an elliptically-shaped sealing element 155 (of rectangular cross section) and a backing bias spring 157 which urges the sealing element 155 into continuous sealing engagement between the rotor disk faces 98, the inner surface 122 of the bar portion of the linkage assembly 104, and the housing body 20.

Figure 14:
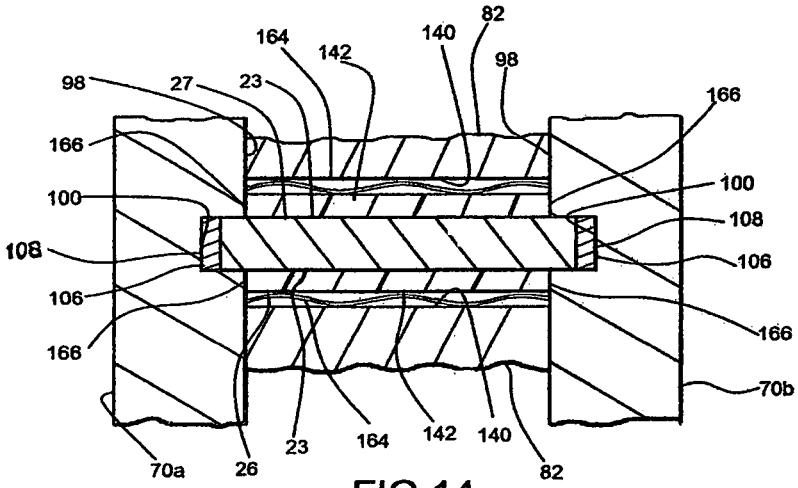
FIG. 14 is a fragmentary cross-sectional view taken along line 14-14 of FIG. 13.
Figures 12, 13:
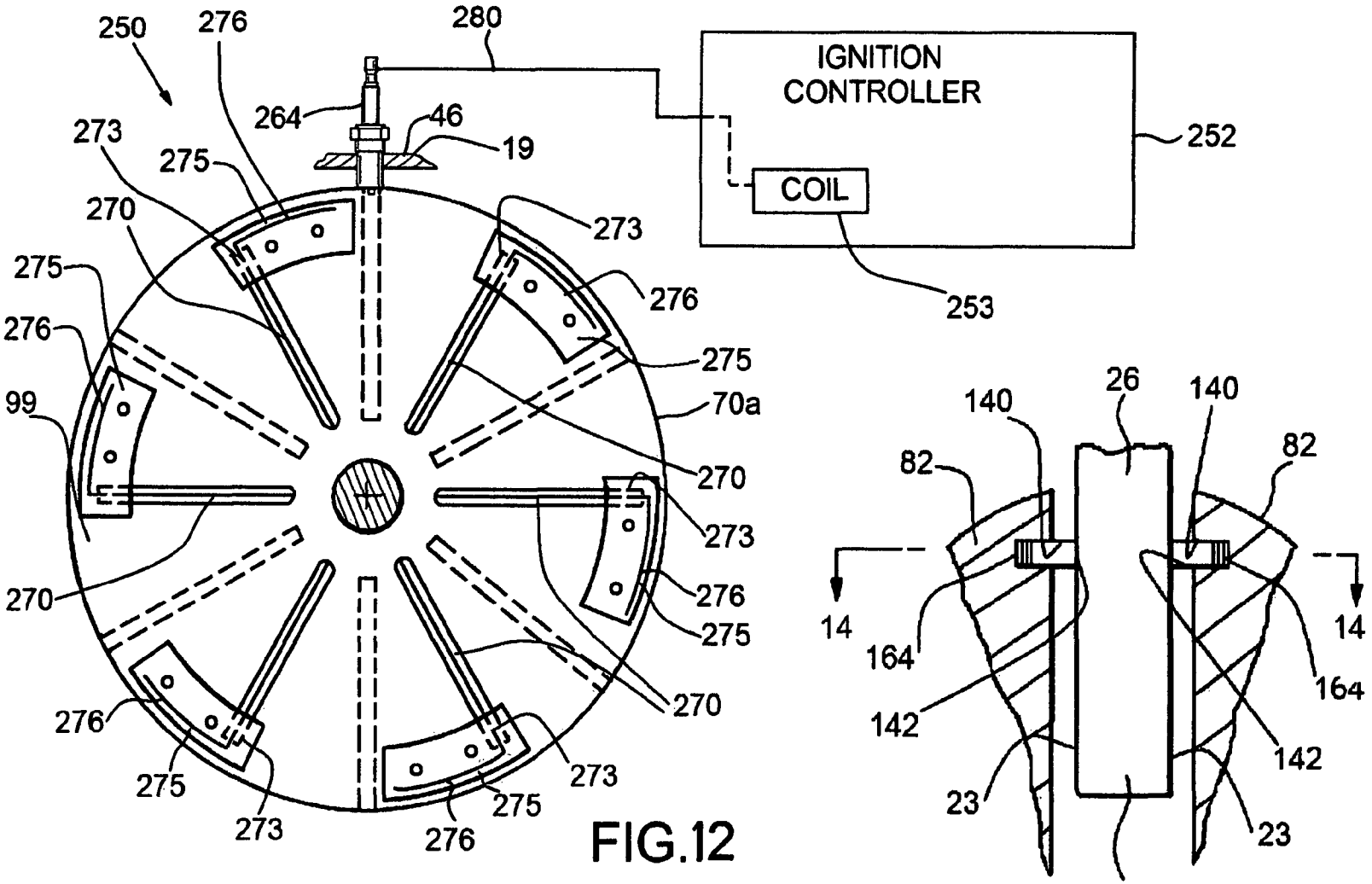
FIG. 12 is a fragmentary cross-sectional view taken about along lines 12-12 of FIG. 5 depicting the relationship between one rotor disk and the high voltage feed-through member of the FIG. 1 engine.
FIG. 13 is a fragmentary cross-sectional view taken about along line 13-13 of FIG. 4.

For purposes of sealing any spacing which may exist between each vane assembly 26 (or more specifically, the vane body 27 of each vane assembly 26) and the hub sectors 82 between which the vane assembly 26 is positioned and with reference to FIG. 13, each face (i.e. a radially-extending surface) of the sectors 82 which faces a side of the corresponding vane body 27 is provided with a sealing groove 140 which extends between along the length of the sector 82 and is situated adjacent the outer periphery of the sector 82. Within this groove 140 is positioned a vane face seal 142, i.e. a mechanical face-type strip seal, for sealing of the clearance between the opposing faces of the vane body 27 and sector 82. This seal 142 is preferably backed by a bias spring 164 which provides and maintains continuous sealing engagement between the sealing groove 140 and the corresponding vane body face 23. Moreover and as best shown in FIG. 14, the seal 142 preferably extends the full width of the sectors 82 between which the seal 142 is positioned so that the opposite ends, indicated 166 in FIG. 14, of the seal 142 sealingly engage the interior faces 98 of the disks 70*a*, 70*b* (which are secured in a stationary relationship against the opposite ends of the sectors 82) to enhance the seal between the seal ends and the disk faces 98.

Further still and as mentioned earlier and with reference to FIGS. 2, 4 and 8, a spark plug 96 is mounted within the substantially flat portion 90 of the outwardly-directed surface 89 of each of the six hub sectors 82 of the rotor 22 so that each working chamber of the housing interior 28 is provided with a spark plug 96 for purposes of igniting the air/fuel mixture contained within the working chamber as the chamber passes near the top dead center location 25 (FIG. 2) of the engine 18. As used herein, the top dead center location 25 can be further defined as the point along the minor axis of the elliptically-shaped inner opening 31 of the engine 18 at which the volume of each working chamber attains its minimum volume in size as each working chamber transitions from its compression cycle to it expansion cycle.

By mounting the spark plugs 96 within the rotor hub sectors 82, rather than within the (outer) wall of the housing interior 28, there is no disruption of the outer wall of the housing interior 28 to accommodate the mounting of a spark plug therein and thereby greatly improves the sealing of the working chambers at the outer edges of the vane tip seals 118. This also provides a more desirable location for the spark for igniting the air/fuel mixture as the spark location is moved more toward the center of the combustion chamber volume and away from the quenching surfaces of the outer wall of the housing interior 28.

Briefly and as best shown in FIG. 8, each spark plug 96 has a hex-shaped head 97, and a body 95 which is externally-threaded for threaded acceptance by an internally-threaded opening disposed substantially centrally of the flat surface portion 90 of the corresponding sector 82. Access to each spark plug 96, for the purpose of removal or replacement, can be had by way of the access passageway 35, best shown in FIG. 2. In this connection, a threaded plug 240 (FIG. 2) is threadably removed from the entrance of, to thereby open, the passageway 35, and the rotor 22 is rotated about the axis 24, as necessary, to position the spark plug 96 (i.e. the one desired to be removed or replaced) in vertical registry with the passageway 35 (FIG. 2). With the desired spark plug 96 positioned in vertical registry with the passageway 35 in this manner, the spark plug 96 can be removed with an appropriate tool directed through the passageway 35.

During the course of engine operation, the spark plugs 96 are energized in a desired sequence and, for example, when each working chamber of the engine 18 approaches near the top dead center location 25 (e.g. during the compression cycle of a working chamber). In other words, each spark plug 96 is intended to ignite the air/fuel mixture contained within the corresponding chamber as the chamber approaches the uppermost, or top dead center location 25, as viewed in FIG. 2, of the housing interior 28. As will be apparent herein, it is a feature of the present invention that the engine 18 includes an arrangement, generally indicated 250 in FIGS. 1 and 8, of conductors which extends between each spark plug 96 and an ignition controller 252 for communicating a high voltage ignition charge from an external ignition coil 253 to each spark plug 96 in a sequential fashion and in a desired timing pattern as the rotor 22 rotates during engine operation.

In connection with the foregoing and with reference to FIG. 8, there is provided within each rotor sector 82 an access passageway 254 which extends substantially axially of the body of the sector 82 from the terminal end of the spark plug 96 and opens out of one side face, indicated 256, of the sector 82, and there is provided within the disk 70*a* (disposed adjacent the sector side face 256) a plurality of openings 258 (FIG. 8) which are each aligned with a corresponding passage 254 opening out of the sector side faces 256. In addition, the disk 70*a* defines an exterior face, indicated 99 in FIG. 8, situated on the side of the disk 70*a* opposite the sector side faces 256. Furthermore, a high voltage feed-through member 264 having an electrode tip 266 and an opposite terminal 268 is fixedly positioned (i.e. threaded) within the top plate 46 of the depicted outer engine housing 19 so that the electrode tip 266 extends into the interior of the outer housing 19.

It will be understood that within the depicted engine 18, each spark plug 96 (six in total) mounted within the engine rotor 22 rotates together with the hub sectors 82 and the disk 70. On the other hand, the engine 18 includes only one high voltage feed through member 264 whose electrode tip 266 remains in a stationary position within the outer housing 19.

With reference to FIGS. 8 and 12, the conductor arrangement 250 includes a series of (i.e. six) elongated and insulated ignition wires 270 wherein each wire member 270 has a portion 271 which extends axially along a sector passageway 254 and is connected at its end 272 to the terminal end of the corresponding spark plug 96 and has another portion 274 which is arranged so as to extend radially along the exterior face 99 and has an end 273 which is disposed adjacent the outer periphery of the disk 70*a*. Inasmuch as the portion 271 of each wire 270 extends substantially axially of the rotor 22 while the portion 274 of each wire 270 extends substantially radially of the disk face 99, wire-accepting grooves 277 are provided within the flange 78 (which is secured in abutting relationship with the disk face 99) for accepting and maintaining a gently curving, right-angle bend of each wire 270 at an elbow.

Furthermore, there is associated with each wire end 273 a contact block 275 which is mounted against the disk face 99 adjacent the periphery thereof. Each contact block 275 is constructed of an electrically insulating material, and each contact block 275 supports an arcuately-formed conductive segment 276 situated adjacent and electrically connected to the wire portion end 273 and which extends along an arcuate path across a radially outwardly-directed surface defined by, for example, by the bottom of a groove formed along, the corresponding contact block 275 so that as the disk 70*a* of the FIGS. 8 and 12 rotates past the high voltage feed-through member 264 to a rotational position about the axis 24 at which each segment 276 passes the electrode 266 of the feed-through member 264, the spark plug 96 is energized by the ignition controller 252 (by way of the high voltage feed-through member 264) and thereby ignites the air/fuel mixture contained within a working chamber of the engine 18. Preferably, the arcuately-formed conductive segments 276 are regularly-arranged in a spaced relationship around the outer side face 99 of the FIG. 12 disk 70*a*.

The ignition controller 252, including an ignition coil 253, is mounted externally of the engine 18, and its high voltage terminal is electrically connected (by way of an insulated conductor 280) to the terminal 268 of the high voltage feed-through member 264 mounted within the top plate 46. Thus, the controller 252, high voltage feed-through member 264, and conductor wires 270 act as a rotating high voltage ignition distributor for the engine 18. If desired, a magneto-type coil (of known construction) can be used in place of the ignition coil 253.

The aforedescribed arrangement of the conductive segments 276 along the disk outer side face 99 is advantageous in that it permits the timing of the spark plug firings to be altered with respect to the rotational position of the working chambers of the housing interior 28 in relation to the uppermost, or top dead center, location 25 (FIG. 2). In other words, if it is desired to fire each spark plug 96 at a preselected position relative to the top dead center location 25 (e.g. in advance of the position at which each spark plug 96 is disposed at the top dead center location 25), the ignition controller 252 can be pre-set, or pre-programmed, to transmit a high voltage charge from the feed-through member 264 to each conductive segment 276 at a preselected location therealong as each segment 276 passes beneath the electrode tip 266 during rotation of the rotor 22 about the axis 24. Thus, the aforedescribed conductor arrangement 250 facilitates an adjustment in the timing of the spark plug firings and is advantageous in this respect.

For a detailed discussion of additional features, such those which relate to lubricating and cooling features, of an engine which are adaptable to the depicted engine 18, reference can be had to my earlier U.S. Pat. No. 5,634,783, the disclosure of which is incorporated herein by reference.

It follows from the foregoing that a guided-vane rotary apparatus has been described whose structure helps to seal the internal working chambers of the apparatus from one another by positioning a seal assembly 200 within the seal-accepting recess 74 defined in the side faces 34 and 36 of the housing block 20. In addition and in the instance in which the apparatus is an internal combustion engine which employs spark plugs 96, the spark plugs 96 are mounted within the rotor 22 of the engine, rather than within the outer walls of the housing block 20, so that any gaps or recesses which might otherwise be defined in the outer walls of the housing block 20 for accepting a spark plug mounted therein, do not exist, and as such, these gaps or recesses cannot contribute to a leakage of gases or fluids between adjacent working chambers of the engine. Accordingly, the mounting of the spark plugs 96 within the rotor 22 of the engine 18 eliminates a region of the engine design which could otherwise permit flow communication between working chambers of the apparatus, and this feature of the depicted engine 18 is advantageous in this respect.

It will be understood that numerous modifications and substitutions can be had to the aforedescribed embodiment 18 without departing from the spirit of the invention. For example, there exists several factors pertaining to the present invention that can be manipulated according to the specific functional objectives to be met, and these factors will greatly influence the operating characteristics and suitability of the machine to a particular purpose. Such factors include housing cavity shape, number of vanes or chambers, and placement, size, shape, transition to housing wall and number of inlet and outlet port openings. For example, the housing wall could be provided with a shape adjacent a port opening which provides an advantageous transition between phases of apparatus operation. Thus, it will be appreciated that the spirit, scope, and fundamental structure of the invention will not be diminished due to the choice of these and other factors for a particular use. Accordingly, the embodiment 18 is intended for the purpose of illustration and not as limitation.

The invention claimed is:

1. A guided-vane rotary apparatus comprising:

a housing including a body having two opposite, substantially planar side faces, an opening having an interior and an outer wall which extends between the two opposite, substantially planar side faces and a seal-accepting recess encircling the opening on one of the two opposite, substantially planar side faces, the outer wall of the opening terminating at an edge disposed adjacent the one of the two opposite, substantially planar side faces, the recess defining a bottom surface which is substantially parallel to the at least one of the two opposite, substantially planar side faces and an outermost surface which extends between the bottom surface and the at least one of the two opposite, substantially planar side faces wherein the bottom surface of the seal-accepting recess extends from the outermost surface of the seal-accepting recess to the edge of the opening so that the seal-accepting recess is contiguous with the opening at the edge thereof;

a rotor assembly including a body mounted within the opening of the housing body for rotation about an axis and defining a slot extending radially of the rotation axis, and the rotor assembly further includes a disk which is mounted adjacent the one of the two opposite, substantially planar side faces of the housing body so as to cover the opening of the housing body and wherein the disk includes an inner side face which faces the one of the two opposite, substantially planar side faces of the housing body, and the one of the two opposite, planar side faces of the housing body defines a cam groove which encircles the opening in the one of the two opposite, substantially planar side faces and is disposed outboard of the recess defined therein;

a vane assembly positioned within the slot of the rotor assembly body for movement radially thereof between alternative radial positions;

means cooperating between the vane assembly and the cam groove for coordinating the radial movement of the vane assembly relative to the rotor assembly body with the rotation of the rotor assembly body about the rotation axis so that the vane assembly is forcibly moved radially inwardly and outwardly with respect to the rotor assembly body by a corresponding amount; and a sealing ring which is accepted by the seal-accepting recess and includes a front face which faces the inner side face of the disk and a rear face opposite the front face; and biasing means disposed between the bottom surface of the seal-accepting recess and the rear face of the sealing ring for urging the front face of the sealing ring axially with respect to the housing body opening and against the inner side face of the disk;

so that when the front face of the sealing ring is urged against the inner side face of the disk as aforesaid, the interior of the opening is sealed from the one of the two opposite, substantially planar side faces of the housing body at the edge of the opening by the sealing ring.

2. The apparatus as defined in claim 1 wherein the sealing ring has an outer surface which extends between the front and rear faces thereof for engaging the outermost surface of the seal-accepting recess and an opposite inner surface, and the vane assembly has an outer edge which moves in engagement along the outer wall of the opening and the inner surface of the sealing ring as the rotor assembly body is rotated about the rotation axis, and the sealing ring has a width as measured between the outer and inner surfaces of the sealing ring which is substantially equal to the distance between the outer edge of the vane assembly and the outermost surface of the seal-accepting recess to seal the engaging surfaces of the outer surface of the sealing ring and the outermost surface of the seal-accepting recess and the engaging surfaces of the inner surface of the sealing ring and the outer edge of the vane assembly.

3. The apparatus as defined in claim 2 wherein the sealing ring is sized so that the outer surface thereof sealingly engages the outermost surface of the seal-accepting recess.

4. The apparatus as defined in claim 1 wherein the sealing ring and biasing means are sized so that, collectively, the sealing ring and the biasing means substantially fill the entirety of the seal-accepting recess of the housing body.

5. The apparatus as defined in claim 1 wherein the biasing means includes a wave spring which is positionable within the seal-accepting recess of the housing body and which is movable axially with respect to the housing body opening between expanded and collapsed conditions, and the wave spring is sized so that when positioned in a collapsed condition between the bottom of the seal-accepting recess and the rear face of the sealing ring, the wave spring substantially fills the space which exists between the bottom surface of the seal-accepting recess and the rear face of the sealing ring.

6. The apparatus as defined in claim 5 wherein the wave spring includes a front surface for engaging the rear face of the sealing ring and a rear surface for engaging the bottom surface of the seal-accepting recess, and each of the front and rear surfaces of the wave spring has a width which is substantially equal to the width of the bottom surface of the seal-accepting recess.

7. The apparatus as defined in claim 5 wherein the seal-accepting recess of the housing body has a depth as measured between the bottom surface and the at least one of the two opposite, planar side faces, the sealing ring has a thickness as measured between the front face and the rear face thereof, and the wave spring has a thickness as measured between the front surface and the rear surface thereof when the wave spring is in its collapsed condition, and the sum of the thicknesses of the sealing ring and the wave spring is at least as great as the depth of the seal-accepting recess of the housing body.

8. The apparatus as defined in claim 1 wherein the vane assembly is adapted to slidably move along the outer wall of the opening during apparatus operation, and the sealing ring has an outer surface which extends between the front and rear faces thereof for engaging the outermost surface of the seal-accepting recess and an opposite inner surface which provides, with the outer wall of the housing body opening, a relatively smooth surface across which the vane assembly slidably moves.

9. The apparatus as defined in claim 1 wherein the seal-accepting recess is a first seal-accepting recess which is defined on one of the two opposite, planar side faces of the housing body, the edge at which the outer wall of the opening terminates is a first edge, the disk is a first disk, the sealing ring is a first sealing ring, and the biasing means is a first biasing means; and the housing body includes a second seal-accepting recess which encircles the opening on the other of the two opposite, planar side faces of the housing body, the outer wall of the opening terminates at a second edge which is disposed adjacent the other of the two opposite, planar side faces, the second seal-accepting recess defines a bottom surface which is substantially parallel to the other of the two opposite, planar side faces and an outermost surface which extends between the bottom surface of the second seal-accepting recess and the other of the two opposite, planar side faces of the housing body, and wherein the bottom surface of the second seal-accepting opening extends from the outermost surface of the second seal-accepting recess to the second edge of the opening so that the second seal-accepting recess is in communication with the opening at the second edge thereof; and the rotor assembly includes a second disk which is mounted adjacent the other of the two opposite, planar side faces of the body so as to cover the opening of the housing body and wherein the second disk includes an inner side face which faces the other of the two opposite, planar side faces of the housing body and the apparatus further includes a second sealing ring which is accepted by the second seal-accepting recess and includes a front face which faces the inner side face of the second disk and a rear face opposite the front face of the second sealing ring; and a second biasing means disposed between the bottom surface of the second seal-accepting recess and the rear face of the second sealing ring for urging the front face of the second sealing ring axially with respect to the housing body opening and against the inner side face of the second disk so that when the front face of the second sealing ring is urged against the inner side face of the second disk as aforesaid, the interior of the opening is sealed from the other of the two opposite, planar side faces of the housing body at the second edge of the opening by the second sealing ring.

10. The apparatus as defined in claim 9 wherein each of the first and second biasing means includes a wave spring wherein each wave spring is positionable within a corresponding one of the first seal-accepting recess and the second seal-accepting recess, of the housing body and between the rear face of a corresponding sealing ring and the bottom surface of the corresponding one of the first seal-accepting recess and the second seal-accepting recess and which is movable axially with respect to the housing body opening between expanded and collapsed conditions, and each wave spring is sized so that when positioned in a collapsed condition between the bottom surface of the corresponding one of the first seal-accepting recess and the second seal-accepting recess and the rear face of the corresponding sealing ring, the wave springs substantially fill the spaces which exist between the bottom surface of the first seal-accepting recess and the rear face of the corresponding sealing ring and between the bottom surface of the second seal-accepting recess and the rear face of the corresponding sealing ring.

11. The apparatus as defined in claim 1 wherein the vane assembly is adapted to slidably move along the outer wall of the opening of the housing body during apparatus operation, and the vane assembly includes a vane body having a radially outwardly-directed edge and two opposite ends, and there is defined along the radially outwardly-directed edge a groove having a bottom which extends therealong, and wherein the vane assembly further includes a vane tip seal which is disposed within the groove and extends therealong so as to provide a radially outwardmost edge of the vane assembly and means disposed between the bottom of the groove and the vane tip seal for biasing the radially outwardmost edge of the tip seal radially outwardly of the rotor assembly and into engagement with the outer wall of the opening of the housing body.

12. The apparatus as defined in claim 11 wherein the vane tip seal has a length which is at least as great as the full width of the opening of the housing body wherein the full width is measured between the two opposite, substantially planar side faces of the housing body.

13. The apparatus as defined in claim 1 wherein the body of the rotor assembly includes two hub sectors having opposing radially-extending surfaces between which is defined the slot within which the vane assembly is positioned, and the vane assembly includes a body having a side face which faces the radially-extending surface of one of the hub sectors and another side face which faces the radially-extending surface of the other of the hub sectors, and each opposing radially-extending surface of the two hub sectors defines a seal-accepting groove which extends substantially axially of the rotor assembly, and the apparatus further includes two strip seals wherein each strip seal is disposed within a seal-accepting groove of a radially-extending surface of a corresponding hub sector and means disposed between the bottom of the seal-accepting groove of a corresponding hub sector and one of the two strip seals accepted by the corresponding seal-accepting groove for biasing the strip seals into sealing engagement with the side faces of the vane assembly body.

14. The apparatus as defined in claim 13 wherein each of the two strip seals has a length which extends substantially the full length of the radially-extending surface of the corresponding hub sector within which the strip seal is disposed.

15. A guided-vane rotary apparatus comprising:

a housing including a body having two opposite, substantially planar side faces, an opening extending between the two opposite, substantially planar side faces;

a rotor assembly including a body mounted within the opening of the housing body for rotation about an axis and defining a slot extending radially of the rotation axis, and each one of the two opposite, substantially planar side faces of the housing body defines a cam groove which encircles the opening in a corresponding one of the two opposite, substantially planar side faces;

a vane assembly positioned within the slot of the rotor assembly body for movement radially thereof between alternative radial positions;

a linkage assembly cooperating between the vane assembly and the cam grooves for coordinating the radial movement of the vane assembly relative to the rotor assembly body with the rotation of the rotor assembly body about the rotation axis so that the vane assembly is forcibly moved radially inwardly and outwardly with respect to the rotor assembly body by a corresponding amount, and wherein the opening of the housing body has an outer wall along which the vane assembly is slidably moved during apparatus operation; and the vane assembly includes a vane body having a radially outwardly-directed edge having two opposite ends and a length which extends from one of the two opposite ends of the radially outwardly-directed edge to the other of the two opposite ends of the radially outwardly-directed edge, and there is defined along the radially outwardly-directed edge a seal-accepting groove having a bottom which extends along the length of the radially outwardly-directed edge from one of the two opposite ends to the other of the two opposite ends; and the linkage assembly includes a pair of bar portions which are interposed between the vane body and the cam grooves and are positioned about the vane body so that the vane body is sandwiched between the pair of bar portions, and each bar portion of the pair of bar portions includes a planar surface which is oriented in a plane which is substantially normal to the axis of rotation of the rotor axis and is disposed adjacent and in a stationary relationship with respect to a corresponding one of the two opposite ends of the radially outwardly-directed edge; and wherein the vane assembly further includes a vane tip seal which is positioned within the seal-accepting groove and extends along the seal-accepting groove from one of the two opposite ends of the radially outwardly-directed edge of the vane body to the other of the two opposite ends of the radially outwardly-extending edge of the vane body so as to extend along the entire length of the seal-accepting groove and between the planar surfaces of the pair of bar portions between which the vane body is sandwiched so as to provide a radially outwardmost edge of the vane assembly and means disposed between the bottom of the groove and the vane tip seal for biasing the radially outwardmost edge of the vane tip seal radially outwardly of the rotor assembly body and into engagement with the outer wall of the opening of the housing body; and wherein the vane tip seal has a length which is at least as great as the full width of the opening of the housing body wherein the full width is measured between the two opposite, substantially planar side faces of the housing body and wherein each vane tip seal has two opposite ends which engage the planar surfaces of the pair of bar portions between which the corresponding vane body is sandwiched.

16. The apparatus as defined in claim 15 wherein the body of the rotor assembly includes two hub sectors having opposing radially-extending surfaces between which is defined the slot within which the vane assembly is positioned, and the vane assembly includes a body having a side face which faces the radially-extending surface of one of the hub sectors and another side face which faces the radially-extending surface of the other of the hub sectors, and each opposing radially-extending surface of the two hub sectors defines a seal-accepting groove which extends substantially axially of the rotor assembly, and the apparatus further includes two vane face seals wherein each vane face seal is disposed within a seal-accepting groove of a radially-extending surface of a corresponding hub sector and means disposed between the bottom of the seal-accepting groove of a corresponding hub sector and the vane face seal accepted by the corresponding seal-accepting groove for biasing the vane face seals into sealing engagement with the side faces of the vane assembly body.

17. The apparatus as defined in claim 16 wherein each vane face seal has a length which extends substantially the full length of the radially-extending surface of the corresponding hub sector within which the strip seal is disposed.

18. A guided-vane rotary apparatus comprising:

a housing including a body having two opposite, substantially planar side faces, an opening extending between the two opposite, substantially planar side faces;

a rotor assembly including a body mounted within the opening of the housing body for rotation about an axis and defining a slot extending radially of the rotation axis, and the rotor assembly further includes a pair of disks which are each mounted adjacent a corresponding one of the opposite, substantially planar side faces of the housing body so as to cover the opening of the housing body and wherein each of the pair of disks includes an inner side face which faces a corresponding one of the opposite, substantially planar side faces of the housing body, and each one of the two opposite, substantially planar side faces of the housing body defines a cam groove which encircles the opening in a corresponding one of the two opposite, substantially planar side faces;

a vane assembly positioned within the slot of the rotor assembly body for movement radially thereof between alternative radial positions;

means cooperating between the vane assembly and the cam grooves for coordinating the radial movement of the vane assembly relative to the rotor assembly body with the rotation of the rotor assembly body about the rotation axis so that the vane assembly is forcibly moved radially inwardly and outwardly with respect to the rotor assembly body by a corresponding amount, and wherein the opening of the housing body has an outer wall along which the vane assembly is slidably moved during apparatus operation; and wherein the body of the rotor assembly includes two hub sectors having opposing radially-extending surfaces between which is defined the slot within which the vane assembly is positioned and the hub sectors extend between the inner side faces of the pair of disks and are mounted in a stationary relationship with respect to the inner side faces of the pair of disks as the rotor assembly rotates within the opening of the housing body, and the vane assembly includes a vane body having a length and having a side face which faces the radially-extending surface of one of the hub sectors and another side face which faces the radially-extending surface of the other of the hub sectors and wherein each side face of the vane body is adapted to move radially across a corresponding radially-extending surface of the one and the other of the hub sectors during rotation of the rotor assembly within the opening of the housing body, and each opposing radially-extending surface of the hub sectors defines a seal-accepting groove which extends substantially axially of the rotor assembly and between the inner faces of the pair of disks; and two strip seals wherein each strip seal is positioned within a seal-accepting groove of a radially-extending surface of a corresponding hub sector and means disposed between the bottom of the seal-accepting groove of a corresponding hub sector and the strip seal accepted by the corresponding seal-accepting groove for biasing the strip seals into sealing engagement with the side faces of the vane assembly body and so that each strip seal which is positioned within the seal-accepting groove of a radially-extending surface of a corresponding hub sector engages the vane body along the length of the vane body and has opposite ends which engage the inner faces of the pair of disks between which the hub sectors extend.

19. The apparatus as defined in claim 18 wherein each vane body has a radially outwardly-directed edge having two opposite ends and a length which extends from one of the two opposite ends of the radially outwardly-directed edge to the other of the two opposite ends of the radially outwardly-directed edge, and there is defined along the radially outwardly-directed edge a seal-accepting groove having a bottom which extends along the length of the radially outwardly-directed edge from one of the two opposite ends to the other of the two opposite ends; and the cooperating means includes a pair of bar portions which are interposed between the vane body and the cam grooves and are positioned about the vane body so that the vane body is sandwiched between the pair of bar portions, and each bar portion of the pair of bar portions includes a planar surface which is oriented in a plane which is substantially normal to the axis of rotation of the rotor axis and is disposed adjacent and in a stationary relationship with respect to a corresponding one of the two opposite ends of the radially outwardly-directed edge; and wherein the vane assembly further includes a vane tip seal which is positioned within the seal-accepting groove and extends along the seal-accepting groove from one of the two opposite ends of the radially outwardly-directed edge of the vane body to the other of the two opposite ends of the radially outwardly-directed edge of the vane body so as to extend along the entire length of the seal-accepting groove and between the planar surfaces of the pair of bar portions between which the vane body is sandwiched so as to provide a radially outwardmost edge of the vane assembly and means disposed between the bottom of the groove and the vane tip seal for biasing the radially outwardmost edge of the vane tip seal radially outwardly of the rotor assembly body and into engagement with the outer wall of the opening of the housing body; and wherein the vane tip seal has a length which is at least as great as the full width of the opening of the housing body wherein the full width is measured between the two opposite, substantially planar side faces of the housing body and wherein each vane tip seal has two opposite ends which engage the planar surfaces of the pair of bar portions between which the corresponding vane body is sandwiched.

* * * * *